US011316245B2

(12) United States Patent
Peng et al.

(10) Patent No.: US 11,316,245 B2
(45) Date of Patent: Apr. 26, 2022

(54) BASE STATION ANTENNA

(71) Applicant: HUAWEI TECHNOLOGIES CO., LTD., Guangdong (CN)

(72) Inventors: Chenggang Peng, Dongguan (CN); Weihong Xiao, Xi'an (CN); Zhixiong Zhao, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 185 days.

(21) Appl. No.: 16/713,542

(22) Filed: Dec. 13, 2019

(65) Prior Publication Data

US 2020/0119426 A1 Apr. 16, 2020

Related U.S. Application Data

(63) Continuation of application No. PCT/CN2018/090996, filed on Jun. 13, 2018.

(30) Foreign Application Priority Data

Jun. 14, 2017 (CN) ..... 201710450381.7

(51) Int. Cl.
*H01Q 1/12* (2006.01)
*H01Q 1/24* (2006.01)
(Continued)

(52) U.S. Cl.
CPC ..... *H01Q 1/1264* (2013.01); *H01Q 1/1228* (2013.01); *H01Q 1/246* (2013.01);
(Continued)

(58) Field of Classification Search
CPC ..... H01Q 1/1264; H01Q 1/246; H01Q 1/42; H01Q 1/428; H01Q 1/1228; H01Q 3/04; H01Q 9/32; H01Q 21/205
See application file for complete search history.

(56) References Cited

U.S. PATENT DOCUMENTS

2004/0066353 A1 4/2004 Ernest Ehlen et al.
2016/0211576 A1 7/2016 Vassilakis

FOREIGN PATENT DOCUMENTS

CN 101471495 A 7/2009
CN 201397878 Y 2/2010
(Continued)

OTHER PUBLICATIONS

PCT International Search Report and Written Opinion issued in International Application No. PCT/CN2018/090996 dated Aug. 24, 2018, 17 pages (with English translation).
(Continued)

*Primary Examiner* — Robert Karacsony
(74) *Attorney, Agent, or Firm* — Fish & Richardson P.C.

(57) ABSTRACT

The present disclosure relates to base station antennas. One example base station antenna includes at least two antennas, at least two outer cover structures, a fastening assembly, a connection assembly, and an upper cover, and each antenna is independently packaged in a radome. The fastening assembly includes a pole and a base. A bottom of the pole is mounted on the base. The connection assembly includes an antenna connection assembly, an outer cover connection assembly, and a pole connection assembly. The pole connection assembly is disposed on the pole, a top of the antenna is connected to the pole by using the antenna connection assembly and the pole connection assembly, and a bottom of the antenna is fastened on the bottom of the pole. Each of the outer cover structures is connected to the pole by using the outer cover connection assembly and the pole connection assembly.

18 Claims, 17 Drawing Sheets

(51) Int. Cl.

| | |
|---|---|
| ***H01Q 1/42*** | (2006.01) |
| ***H01Q 3/04*** | (2006.01) |
| ***H01Q 9/32*** | (2006.01) |
| ***H01Q 21/20*** | (2006.01) |

(52) U.S. Cl.
CPC ..... *H01Q 1/42* (2013.01); *H01Q 1/428* (2013.01); *H01Q 3/04* (2013.01); *H01Q 9/32* (2013.01); *H01Q 21/205* (2013.01)

(56) References Cited

FOREIGN PATENT DOCUMENTS

| | | | |
|---|---|---|---|
| CN | 202395157 | U | 8/2012 |
| CN | 102983387 | A | 3/2013 |
| CN | 104779441 | A | 7/2015 |
| CN | 205004447 | U | 1/2016 |
| CN | 107394339 | A | 11/2017 |
| EP | 2289124 | A2 | 3/2011 |
| WO | 2008095712 | A1 | 8/2008 |
| WO | 2017072455 | A1 | 5/2017 |

OTHER PUBLICATIONS

Office Action issued in Chinese Application No. 201710450381.7 dated Apr. 3, 2019, 7 pages (with English Translation).
Extended European Search Report issued in European Application No. 18816541.9 dated Apr. 9, 2020, 10 pages.

BASE STATION ANTENNA

CROSS-REFERENCE TO RELATED APPLICATIONS

This application is a continuation of International Application No. PCT/CN2018/090996, filed on Jun. 13, 2018, which claims priority to Chinese Patent Application No. 201710450381.7, filed on Jun. 14, 2017. The disclosures of the aforementioned applications are hereby incorporated by reference in their entireties.

TECHNICAL FIELD

The present invention relates to the field of communications technologies, and in particular, to an antenna applied to a base station.

BACKGROUND

In engineering systems such as wireless communications, broadcast televisions, radar, and aeronautic and marine navigation, a radio wave is required for transmitting information to accomplish work of an entire system. An antenna is a basic device used in these systems to transmit and receive a radio wave. In a radio system, a radio frequency signal output by a transmitter is transmitted to an antenna through a feeder, and the antenna transmits the signal in a form of electromagnetic wave. The transmitted electromagnetic wave also needs to be received by using an antenna, and then is transmitted to a radio receiver by using a feeder, to implement propagation of a radio wave in space.

With reference to FIG. 1, to implement 360-degree coverage of a conventional base station antenna, generally two or more antennas 110 are mounted on one pole. For example, three multi-sector antennas shown in FIG. 1 are widely applied. With reference to FIG. 2, to achieve a better appearance, an outer cover 120 is usually added outside the three antennas 110.

In a base station antenna in a conventional method, each antenna is independently packaged in a radome, and then three antennas are packaged together by using a cylindrical outer cover. In this way, a signal needs to pass through two layers of covers (the radome and the outer cover) during transmission, leading to high signal attenuation.

SUMMARY

Embodiments of the present invention provide a base station antenna, to reduce signal attenuation of the base station antenna, and an azimuth of the antenna can be adjusted without removing an outer cover.

The embodiments of the present invention provide a base station antenna, including: at least two antennas, at least two outer cover structures, a fastening assembly, a connection assembly, and an upper cover. Each antenna is independently packaged in a radome. The fastening assembly includes a pole and a base, and a bottom of the pole is mounted on the base. The connection assembly includes an antenna connection assembly, an outer cover connection assembly, and a pole connection assembly. The pole connection assembly is disposed on the pole, a top of the antenna is connected to the pole by using the antenna connection assembly and the pole connection assembly, and a bottom of the antenna is fastened on the bottom of the pole. Each outer cover structure is connected to the pole by using the outer cover connection assembly and the pole connection assembly. The upper cover is disposed on the top of the antenna. Each outer cover structure and the antenna are disposed alternately. An attachment portion on a side edge of the outer cover structure is attached to an outer side wall of the radome. The outer side wall of the radome, the outer cover structure, and the upper cover jointly form an outer cover of the antenna. The outer cover structure is an arc structure. Under a deformation elastic force of the arc structure, the outer cover structure is attached to the outer side wall of the radome. Therefore, installation is simple and convenient with fewer installation steps, and the outer cover structure is tightly attached to the outer side wall of the radome. In this embodiment of the present invention, the outer cover structure and the antenna are disposed alternately, the attachment portion on the side edge of the outer cover structure is attached to the outer side wall of the radome, and the outer side wall of the radome, the outer cover structure, and the upper cover jointly form the outer cover of the antenna. A signal transmitted by the base station antenna needs to pass through only one layer of radome, thereby changing high signal attenuation in a conventional manner in which a signal of a base station antenna needs to pass through two layers of covers (an outer cover and a radome). In this embodiment, because a signal passes through only one layer of radome, signal attenuation of the base station antenna is reduced, and electrical performance of the antenna is ensured. The antenna connection assembly includes a bottom connecting piece, where the bottom connecting piece is fastened on the bottom of the antenna, and a first fastening hole is provided on the bottom connecting piece. The base includes an arc groove, a first bolt passes through the first fastening hole to fasten the bottom connecting piece to the arc groove, so that the first bolt moves in the arc groove, and for each antenna, an azimuth of a single antenna is adjusted by centering on the pole. When an azimuth of a single antenna is adjusted, an antenna fastening bolt is loosened, and the antenna is rotated, so that the first bolt slides in the arc groove. In this way, the azimuth of the single antenna is adjusted. The azimuth refers to a degree of a central angle at which the antenna rotates by centering on the pole. A manner of adjusting the azimuth is simple and convenient: Only the first bolt needs to be loosened, then the first bolt is adjusted to slide in the arc groove, and finally the bolt is tightened, so that the antenna is fastened at a position as required. In this embodiment, the antenna can easily slide in the base, so that a fastening position of the antenna on the base is changed. The azimuth of the single antenna is adjusted only on the bottom of the antenna, so that in the process of adjusting the azimuth of the single antenna, tilt is not caused by unsynchronized sliding of the top and the bottom of the antenna, and a coverage effect of the base station antenna is not affected.

In a possible implementation, the antenna connection assembly includes a top connecting piece, one end of the top connecting piece is fastened to the antenna, and the other end of the top connecting piece is connected to the pole connection assembly.

In a possible implementation, a second fastening hole is provided on the other end of the top connecting piece, and a guide pin passes through the second fastening hole to fasten the other end of the top connecting piece to the pole connection assembly, so that the antenna rotates around the guide pin. In this embodiment, when the azimuth of the single antenna is adjusted, because a connection manner between the bottom of the antenna and the base may enable the bottom of the antenna to move, the top of the antenna may also rotate accordingly. The antenna is stably fastened to the pole, so that when the azimuth is adjusted, the antenna may always be perpendicular to the base without tilt. A structure of the fastening manner is simple, and installation costs are reduced in an actual application.

In a possible implementation, to prevent a bird from building a nest on the upper cover, or snow accumulation, the upper cover is of a conical structure.

In a possible implementation, each outer cover connection assembly includes a first connecting piece, one end of the first connecting piece is fastened on a top of the outer cover structure, the pole connection assembly includes a first pole connecting piece, the first pole connecting piece is disposed on a top of the pole, and a position of the first pole connecting piece corresponds to a position of the first connecting piece; and a reverse guide pin is disposed on the first pole connecting piece, a guide pin hole is provided on the other end of the first connecting piece, and the reverse guide pin passes through the guide pin hole, so that the first connecting piece is fastened to the first connection base.

In a possible implementation, each outer cover connection assembly further includes a second connecting piece, one end of the second connecting piece is fastened on a bottom of the outer cover structure, the pole connection assembly includes a second pole connecting piece, a position of the second pole connecting piece corresponds to a position of the second connecting piece, and the other end of the second connecting piece is connected to the second pole connecting piece.

In a possible implementation, a shielding ring is disposed at a part connecting the radome and the base; the shielding ring is disposed on the bottom of the antenna, and is configured to seal a gap between the outer cover structure and the base; and the shielding ring may be an integrated structure, or may be divided into two parts, where each part is a semi-circular structure, and the two parts are a first shielding ring and a second shielding ring, that is, the first shielding ring is a semi-circular structure, and the second shielding ring is a semi-circular structure. Screws are pre-installed on two ends of the first shielding ring, fastening nuts are disposed two ends of the second shielding ring, and the first shielding ring and the second shielding ring are fastened on the bottom of the antenna through locking by using the screws and the nuts.

In a possible implementation, a bottom flange is fasten on a bottom of the base, a sliding groove is provided on the bottom flange, a third bolt passes through the sliding groove and fastens the bottom flange to a flange of a monopole tower top, and an azimuth of the base station antenna is adjusted by changing a position of the third bolt in the sliding groove. When the azimuth of the base station antenna is adjusted, the third bolt fastened to the flange of the tower top is loosened, and the base station antenna is rotated leftward or rightward, so that the third bolt rotates in the sliding groove, and the azimuth of the entire base station antenna is adjusted.

In a possible implementation, to facilitate installation and transportation in engineering, the pole may alternatively be of a separated structure; and in the separated structure, the pole includes an upper pole and a lower pole, and the upper pole is flexibly connected to the lower pole.

In a possible implementation, the radome is cylindrical, a cross section of the radome is a sector, the outer cover structure is a curved monolithic structure, and a degree of a central angle of the outer cover structure is:

$$y = \frac{360° - nx}{n} + a,$$

where x is a degree of a sector central angle of the antenna, n is a quantity of antennas, a is a degree of a central angle of the attachment portion, and 2a is less than x. A curved surface of a first attachment portion of a first outer cover structure and a curved surface of a second attachment portion of a second outer cover structure are smaller than the outer side wall of the radome. That is, the first attachment portion and the second attachment portion cannot cover the outer side wall of the radome, to ensure that a signal transmitted by the antenna in the radome passes through only one layer of radome, and ensure electrical performance of the antenna.

DESCRIPTION OF EMBODIMENTS

Embodiments of the present invention provide a base station antenna, to reduce signal attenuation of the base station antenna and ensure electrical performance of the antenna.

In the specification, claims, and accompanying drawings of the present invention, the terms "first", "second". "third", "fourth", and so on (if any) are intended to distinguish between similar objects but do not necessarily indicate a specific order or sequence. It should be understood that the data termed in such a way are interchangeable in proper circumstances so that the embodiments of the present invention described herein can be implemented in other orders than the order illustrated or described herein. Moreover, the terms "include", "contain" and any other variants mean to cover the non-exclusive inclusion, for example, a process, method, system, product, or device that includes a list of steps or units is not necessarily limited to those steps or units, but may include other steps or units not expressly listed or inherent to such a process, method, system, product, or device.

Figure 1:
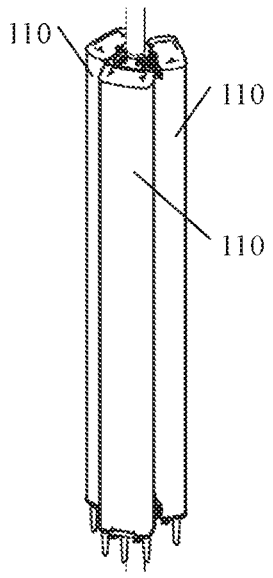
FIG. 1 is a schematic structural diagram of a conventional base station antenna.
Figure 2:
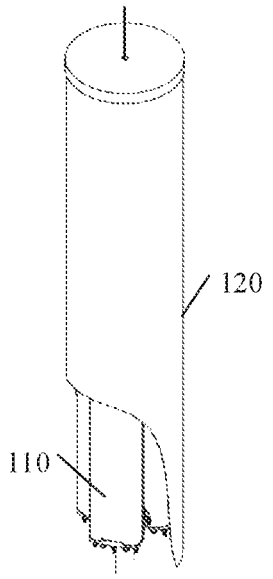
FIG. 2 is a schematic structural diagram of a conventional base station antenna with an outer cover.
Figure 3:
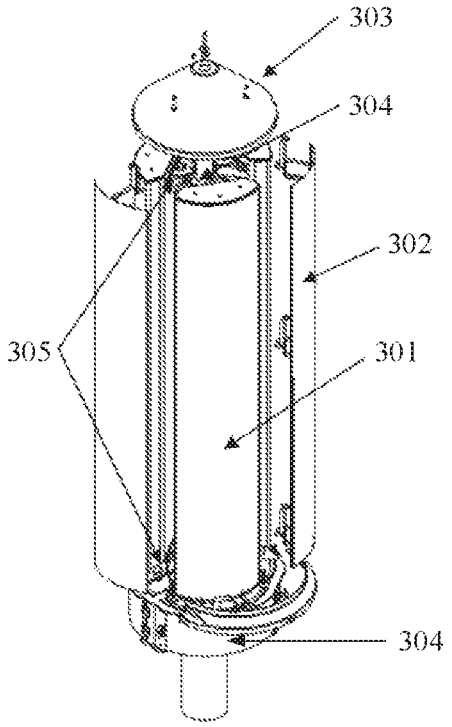
FIG. 3 is a schematic structural exploded view of a base station antenna according to an embodiment of the present invention.
Figure 4:
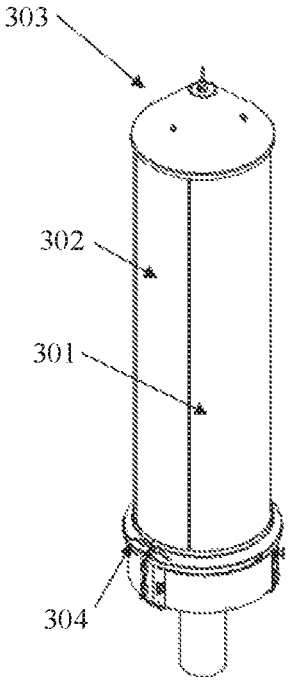
FIG. 4 is a three-dimensional schematic structural diagram of a base station antenna according to an embodiment of the present invention.

An embodiment of the present invention provides a base station antenna, which may be understood with reference to FIG. 3. FIG. 3 is a schematic structural exploded view of the base station antenna according to this embodiment of the present invention. FIG. 4 is a three-dimensional schematic structural diagram of the base station antenna according to this embodiment of the present invention. The base station antenna includes at least two antennas 301, at least two outer cover structures 302, a fastening assembly 304, a connection assembly 305, and an upper cover 303. Each antenna is independently packaged in a radome. For ease of description, in this embodiment, for example, there are three antennas and three outer cover structures.

Figure 5:
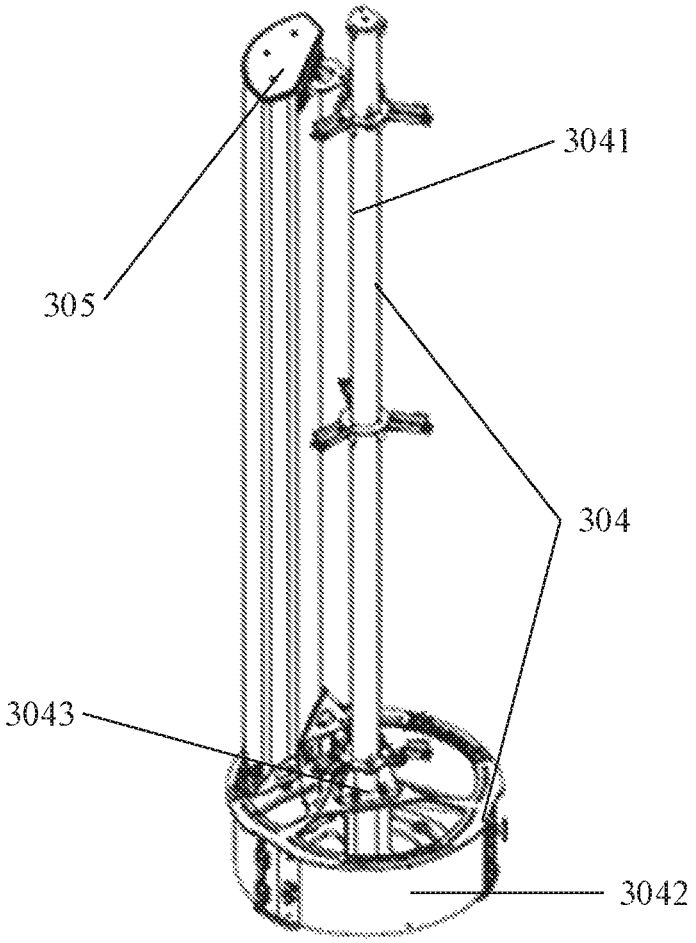
FIG. 5 is a schematic structural diagram of a fastening assembly according to an embodiment of the present invention.

FIG. 5 is a schematic structural diagram of the fastening assembly. The fastening assembly 304 includes a pole 3041 and a base 3042. A bottom of the pole 3041 is mounted on the base 3042. For example, the base 3042 may be of a cylindrical structure, the base 3042 includes a connection portion, and the base 3042 has a cavity. The connection portion is configured to connect the antenna and the pole 3041, and the cavity is configured to accommodate a feeder of the antenna.

A pole mounting hole 3043 is provided at a cylindrical center of the base 3042. The bottom of the pole 3041 is inserted into the pole mounting hole 3043 and is fastened with a screw, so that the bottom of the pole 3041 is connected to the base 3042.

Figure 6:
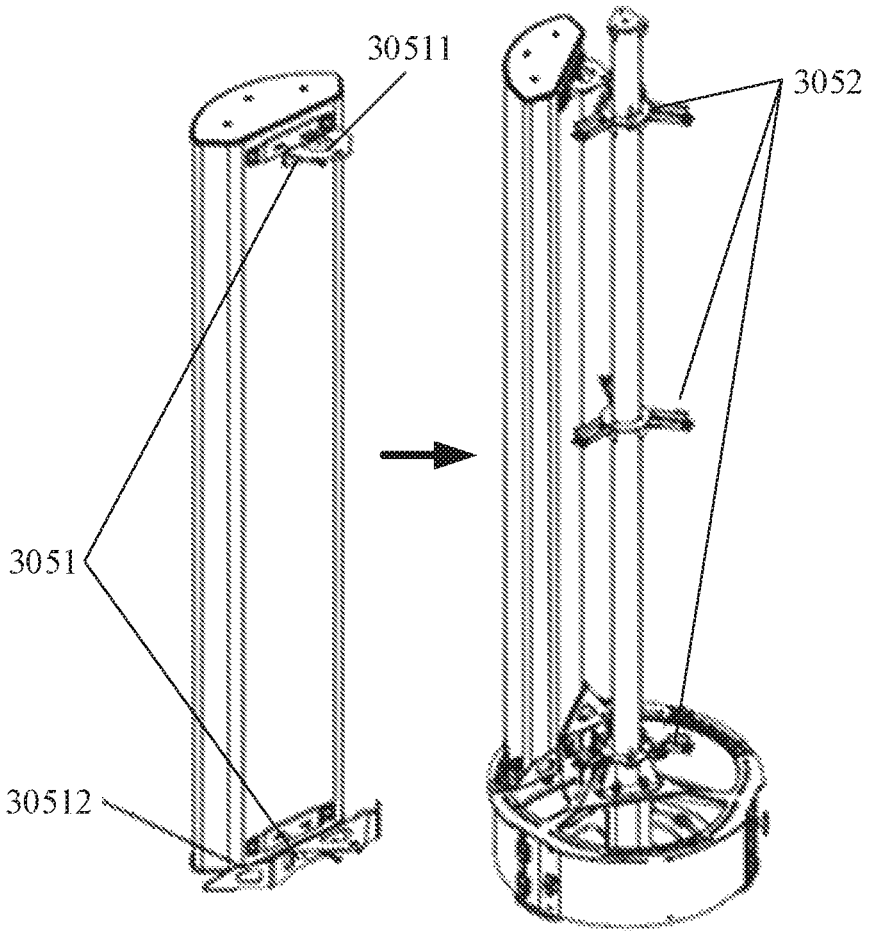
FIG. 6 is a schematic structural diagram in which an antenna is connected to a fastening assembly according to an embodiment of the present invention.

FIG. 6 is a schematic structural diagram in which the antenna is connected to the fastening assembly. The connection assembly includes an antenna connection assembly 3051, an outer cover connection assembly 3053, and a pole connection assembly 3052. The pole connection assembly 3052 is disposed on the pole. A top of the antenna is fastened to the antenna connection assembly 3051. The antenna connection assembly 3051 is connected to the pole connection assembly 3052. That is, the antenna is connected to the pole by using the antenna connection assembly 3051 and the pole connection assembly 3052, and a bottom of the antenna is fastened to the pole 3041.

Each outer cover structure 302 is connected to the pole 3041 by using the outer cover connection assembly 3053 and the pole connection assembly 3052. The upper cover 303 is disposed on the top of the antenna.

Figure 7:
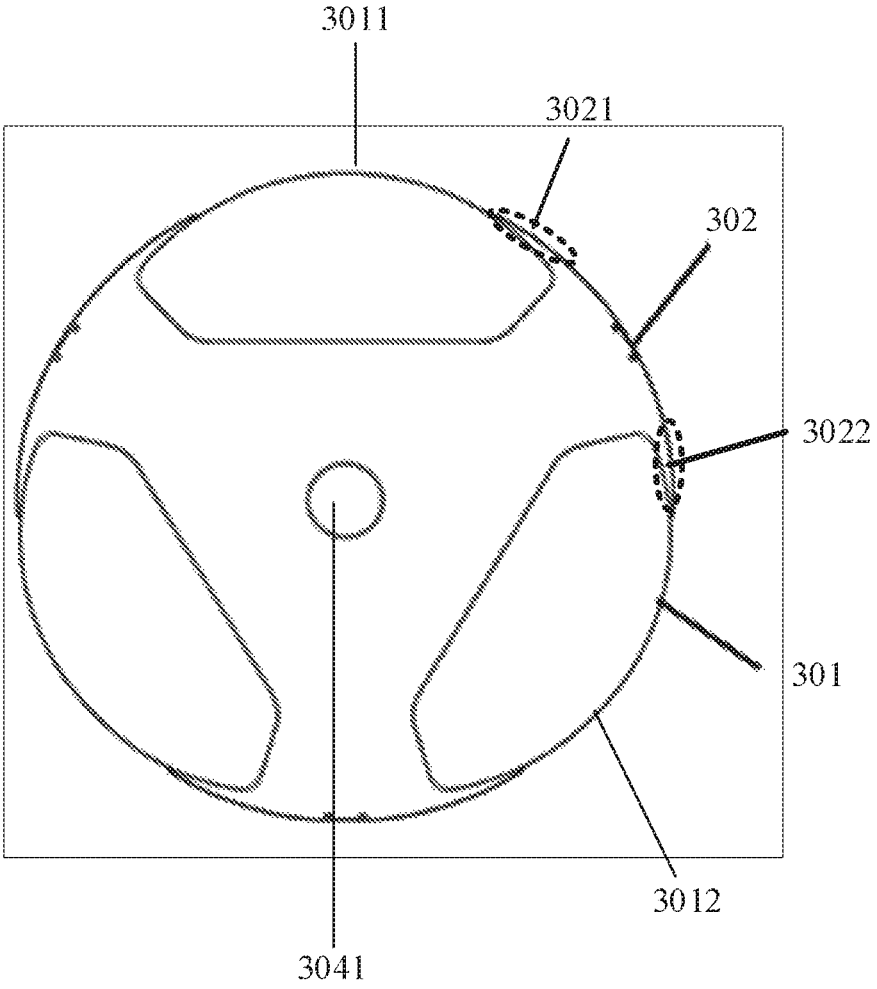
FIG. 7 is a schematic sectional view in which an outer cover structure is attached to an antenna according to an embodiment of the present invention.

FIG. 7 is a schematic sectional view of disposing positions of the outer cover structure and the antenna. Each outer cover structure 302 is disposed between two antennas 301, and the outer cover structure 302 and the antenna 301 are disposed alternately. It may be understood that, when there are three antennas 301, to fasten the antennas 301 more stably, the three antennas 301 are separately connected to the pole, and the pole fastens the antennas 301.

As shown in FIG. 7, the three antennas 301 are disposed around the pole 3041 and are connected to the pole 3041, and the antennas 301 are spaced apart from each other. The outer cover structure 302 is configured to connect two antennas 301, so that outer side walls of the three antennas 301 form an integral structure. It should be noted that, in this embodiment, that the outer cover structure 302 is "connected to" the antenna 301 means that an attachment portion of the outer cover structure 302 is attached to an outer side wall of the radome of the antenna 301. The outer cover structure 302 is an arc structure. Under a deformation elastic force of the arc structure, the outer cover structure 302 is attached to the outer side wall of the radome. Therefore, installation is simple and convenient with fewer installation steps, and the outer cover structure is tightly attached to the outer side wall of the radome.

With reference to FIG. 7, each antenna 301 is independently packaged in a radome, the radome is cylindrical, a cross section of the cylinder is a sector, and an outer side wall of the cylinder is a curved surface. This embodiment includes three antennas and three outer cover structures, and the three outer cover structures are respectively a first outer cover structure, a second outer cover structure, and a third outer cover structure. Each outer cover structure 302 may be a curved monolithic structure, each outer cover structure 302 includes an attachment portion, and the attachment portion is a part of a specific width on two side edges of the outer cover structure. For example, attachment portions on the two side edges of the outer cover structure 302 include a first attachment portion 3021 and a second attachment portion 3022. The first attachment portion 3021 is attached to an outer side wall of an adjacent first radome 3011, and the second attachment portion 3022 is attached to an outer side wall of an adjacent second radome 3012. The outer cover structure is a curved monolithic structure, and under a specific elastic force, the outer cover structure is always attached to the outer side wall of the radome.

The outer side wall of the radome, the outer cover structure 302, and the upper cover 303 jointly form an outer cover of the antenna.

Figure 8:
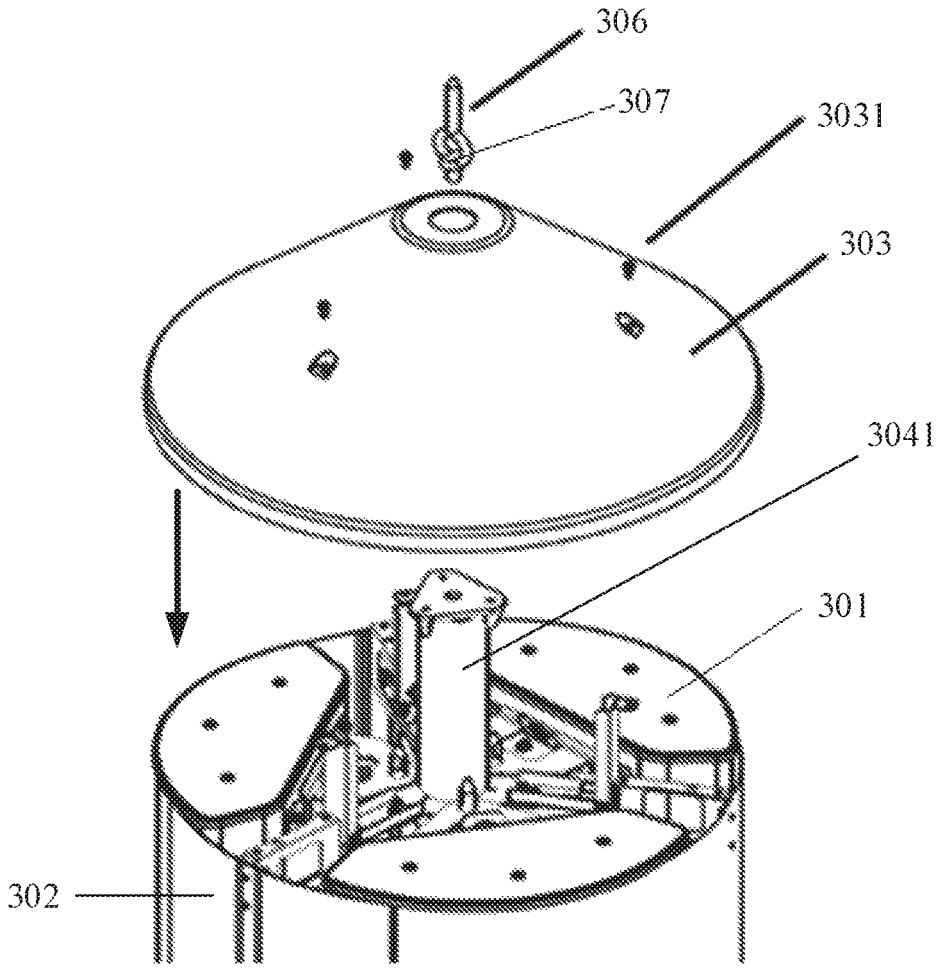
FIG. 8 is a schematic structural diagram of an upper cover according to an embodiment of the present invention.

Optionally, FIG. 8 is a schematic structural diagram of the upper cover. To prevent a bird from building a nest on the upper cover, or snow accumulation, the upper cover 303 is of a conical structure. The upper cover 303 is fastened on a top of the pole 3041 by using a fastening bolt 3031, and a lightning rod 306 is disposed on a top of the upper cover 303. The lightning rod 306 and a lifting eye 307 are integrally designed, and the lifting eye 307 is configured to hoist the entire base station antenna.

In this embodiment of the present invention, the outer cover structure and the antenna are disposed alternately. The attachment portion on the side edge of the outer cover structure is attached to the outer side wall of the radome. The outer side wall of the radome, the outer cover structure, and the upper cover jointly form the outer cover of the multi-sector antenna. A signal transmitted by the base station antenna needs to pass through only one layer of radome, thereby changing high signal attenuation in a conventional manner in which a signal of a base station antenna needs to pass through two layers of covers (an outer cover and a radome). In this embodiment, because a signal passes through only one layer of radome during transmission, signal attenuation of the base station antenna is reduced.

Figure 9:
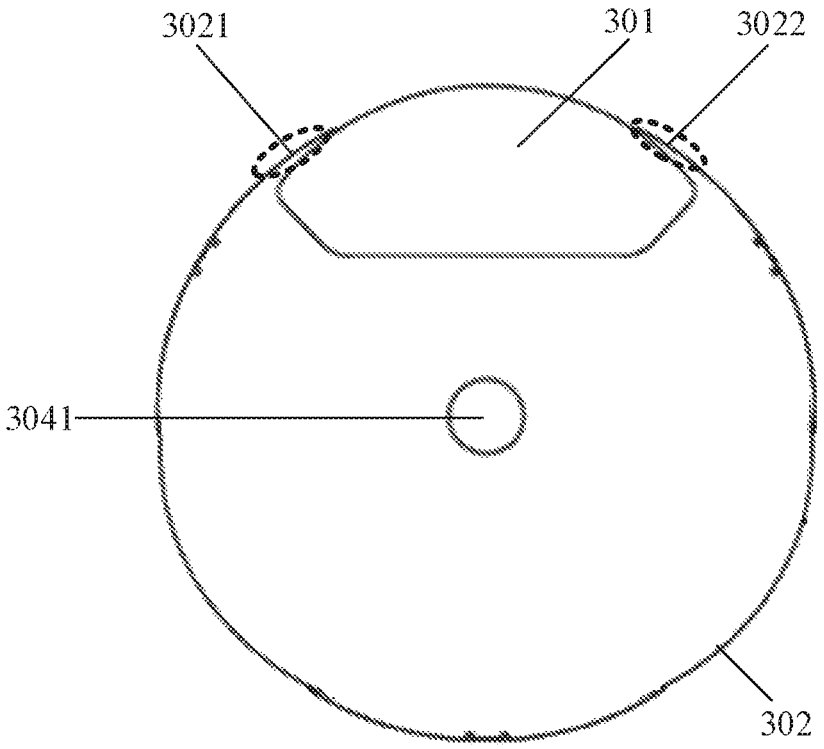
FIG. 9 is a schematic sectional view in which an outer cover structure is attached to an antenna according to an embodiment of the present invention.

In the foregoing example, a quantity of outer cover structures and a quantity of antennas are both three. In practice, the antenna in this embodiment of the present invention may alternatively include one outer cover structure and one antenna, which may be understood with reference to FIG. 9. FIG. 9 is a schematic sectional view in which one outer cover structure is attached to one antenna. A part of a specific width on two side edges of the outer cover structure 302 is an attachment portion. The outer cover structure includes a first attachment portion 3021 and a second attachment portion 3022, the first attachment portion 3021 is attached to one side of the outer side wall of the radome, and the second attachment portion 3022 is attached to the other side of the outer side wall of the radome.

The outer side wall of the radome, the outer cover structure 302, and the upper cover 303 jointly form the outer cover of the multi-sector base station antenna.

Figure 10:
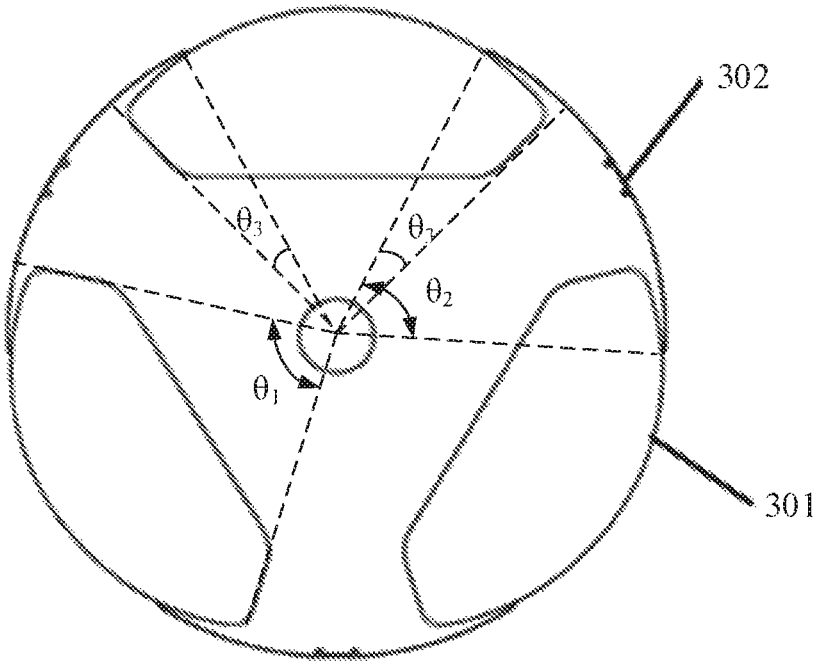
FIG. 10 is a schematic sectional view in which an outer cover structure is attached to an antenna according to an embodiment of the present invention.

It should be noted that, in this embodiment of the present invention, a quantity of outer cover structures 302 and a quantity of antennas 301 are not limited, the outer cover structure 302 and the antenna 301 are disposed alternately, the outer cover structure 302 is connected to the pole 3041, and the antenna 301 is also connected to the pole 3041. The quantity of outer cover structures 302 is the same as the quantity of antennas 301, and a degree of a curved surface of the outer cover structure 302 is related to the quantity of antennas 301 included in the base station antenna 301. With reference to FIG. 10, if a degree of a sector central angle ($\theta_1$) of each antenna 301 is fixed, for example, the sector central angle of each antenna 301 is 80 degrees, and if the base station antenna includes three antennas 301 and three outer cover structures 302, a central angle ($\theta_2$) of each outer cover structure 302 is 50 degrees (During calculation based on the 80-degree sector central angle of each antenna 301, the central angle of each outer cover structure 302 should be 40 degrees; however, the outer cover structure 302 needs to include the attachment portions on the two side edges; therefore, the central angle of the outer cover structure 302 needs to be greater than 40 degrees). That is, if the degree of the sector central angle of each antenna 301 is x, and the quantity of antennas 301 is n, the degree of the central angle of the outer cover structure 302 is calculated by using formula 1:

$$y = \frac{360° - nx}{n} + a$$

where a ($\theta_3$) may be a constant. For example, a may be 10 degrees. 2a is less than x. With reference to FIG. 10, 2a is less than x, so that the curved surface of the first attachment portion of the first outer cover structure 302 and the curved surface of the second attachment portion of the second outer cover structure 302 are smaller than the outer side wall of the radome of the antenna 301. That is, the first attachment portion of the outer cover structure and the second attachment portion of the outer cover structure cannot cover the outer side wall of the radome of the antenna 301, so as to ensure that a signal transmitted by the antenna 301 passes through only one layer of radome, and ensure electrical performance of the antenna 301.

In an embodiment of the present invention, based on the foregoing embodiment, this embodiment of the present invention provides another embodiment of a base station antenna, including the following.

The base station antenna includes at least two antennas 301, at least two outer cover structures 302, a fastening assembly 304, a connection assembly, and an upper cover 303. For ease of description, in this embodiment, for example, there are three antennas 301 and three outer cover structures 302. Each antenna 301 is independently packaged in a radome of one antenna 301.

The connection assembly includes an antenna connection assembly 3051, an outer cover connection assembly 3053, and a pole connection assembly 3052. The pole connection assembly 3052 is disposed on a pole. A top of the antenna is fastened to the antenna connection assembly 3051. The antenna connection assembly is connected to the pole connection assembly 3052. That is, the antenna is connected to the pole by using the antenna connection assembly 3051 and the pole connection assembly 3052, and a bottom of the antenna is fastened to a base 3042.

Figure 11:
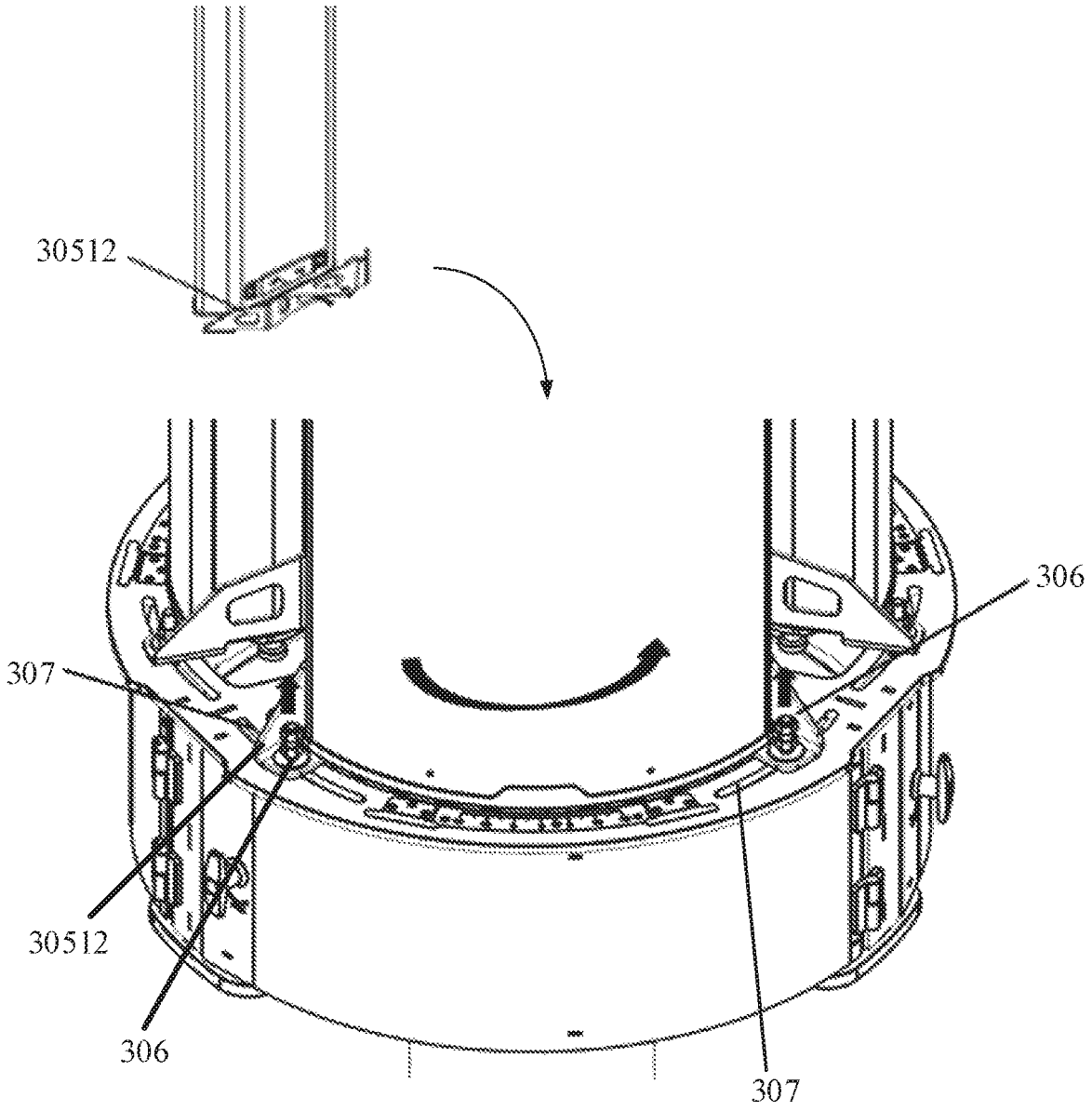
FIG. 11 is a schematic structural diagram in which an antenna is fastened to a base according to an embodiment of the present invention.

Specifically, with reference to FIG. 6 and FIG. 11, FIG. 11 is a schematic structural diagram in which the antenna is fastened to the base. A first fastening hole is provided on a bottom connecting piece 30512. A flange is disposed on the base, and the flange includes an arc groove 307. A first bolt 306 passes through the first fastening hole to fasten the bottom connecting piece 30512 to the arc groove 307, and a function of the arc groove 307 is to enable the first bolt 306 to slide in the arc groove 307. When an azimuth of a single antenna is adjusted, an antenna fastening bolt is loosened, and the antenna is rotated, so that the first bolt 306 slides from one position to another position in the arc groove 307. Then, the bolt is tightened. In this way, the azimuth of the single antenna is adjusted. The azimuth refers to a degree of a central angle at which the antenna rotates by centering on the pole.

In this embodiment, a fastening position of the antenna 301 on the base 3042 may be changed by providing the arc groove 307. In other words, the azimuth of each antenna is adjusted by changing the fastening position of the antenna 301 on the base 3042, and the azimuth of each antenna is adjusted independently.

Because a connection manner between the bottom of the antenna and the base enables the bottom of the antenna to move, the top of the antenna may also rotate accordingly. In this embodiment, a manner of adjusting the azimuth is simple and convenient: Only the first bolt 306 needs to be loosened, then the first bolt 306 is adjusted to slide in the arc groove 307, and finally the bolt is tightened, so that the antenna is fastened at a position as required. The fastening position of the base station antenna is changed on the base by using the arc groove, ensuring that in a process of adjusting the azimuth of the antenna, the antenna can easily slide in the base 3042. It can be learned that in this application, an azimuth of a single antenna is adjusted only on the bottom of the antenna, so that in a process of adjusting the azimuth of the single antenna, tilt is not caused by unsynchronized sliding of the top and the bottom of the antenna, and a coverage effect of the base station antenna is not affected.

Figure 12:
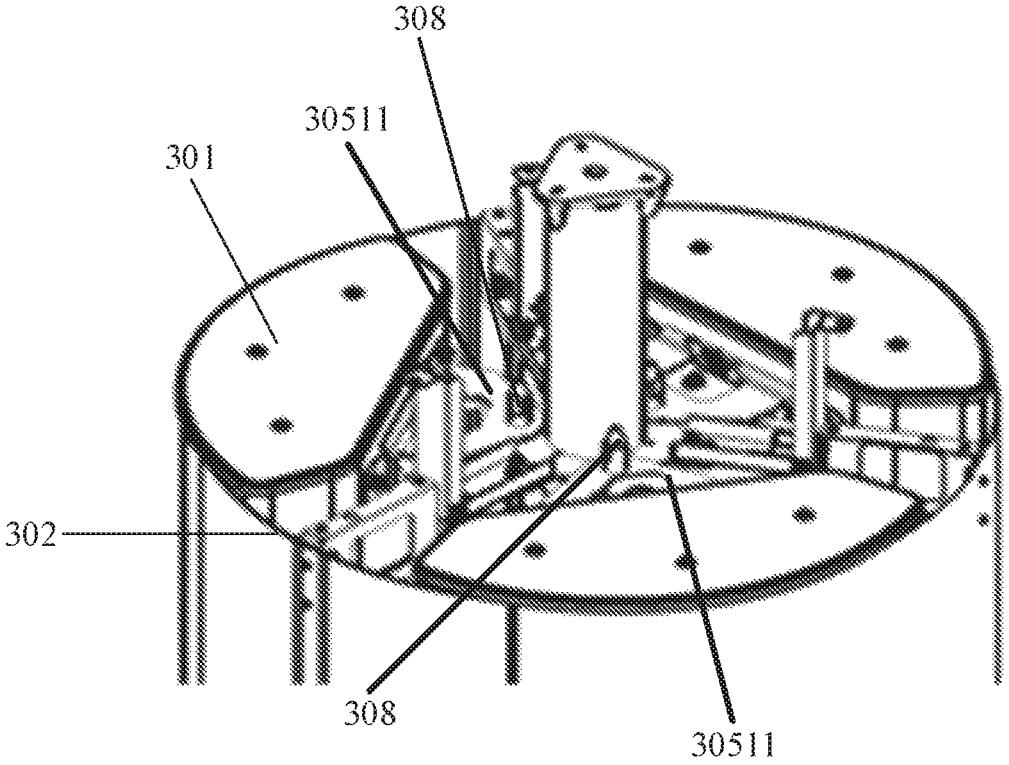
FIG. 12 is a schematic structural diagram in which an antenna is connected to a pole according to an embodiment of the present invention.

FIG. 12 is a schematic structural diagram in which the antenna is connected to the pole. The antenna connection assembly includes a top connecting piece 30511, one end of the top connecting piece 30511 is fastened on the top of the antenna, and the other end of the top connecting piece 30511 is connected to the pole connection assembly disposed on the pole. A guide pin 308 is disposed on the pole connection assembly 3052, a second fastening hole is provided on the other end of the top connecting piece 30511, and the guide pin 308 passes through the second fastening hole to fasten the other end of the top connecting piece 30511 to the pole connection assembly 3052, so that the antenna rotates around the guide pin 308.

In this embodiment, because the arc groove is provided on the base, the fastening position of the antenna on the base may be changed, and an azimuth of a single antenna may be adjusted. In this embodiment, antennas and the base are connected in a same manner, and the antennas and the pole are connected in a same manner. In this embodiment, for ease of description, only one antenna is used as an example for description. In this embodiment, each antenna is fastened to the base by using the first bolt, without affecting a connection manner between the outer cover structure and the pole. The following describes in detail how the outer cover structure is connected to the pole. In this embodiment, the base station antenna includes three outer cover structures. For ease of description, a connection manner between only one of the three outer cover structures and the pole is described herein. Connection manners between the other two outer cover structures and the pole are not described in detail in this embodiment.

Figure 13:
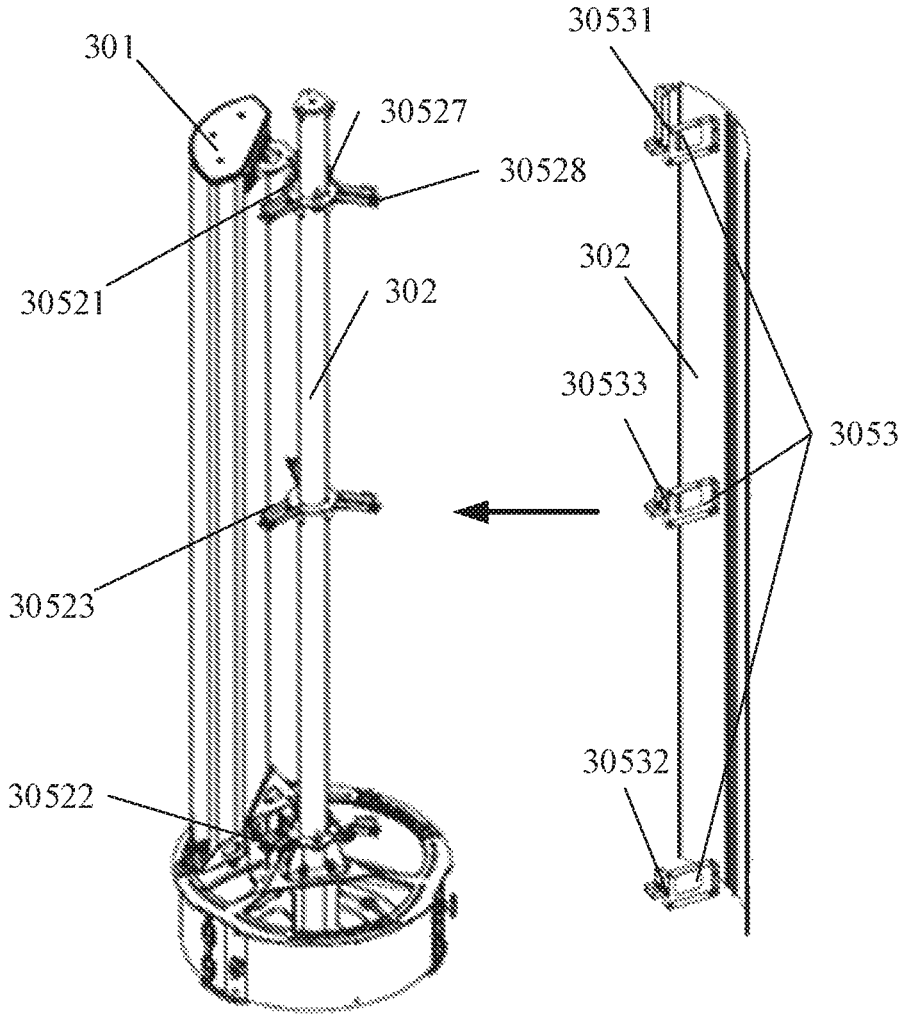
FIG. 13 is a schematic structural diagram in which an outer cover structure is mounted on a pole according to an embodiment of the present invention.

FIG. 13 is a schematic structural diagram in which an outer cover structure is mounted on a pole. Each outer cover connection assembly 3053 includes two connecting pieces: a first connecting piece 30531 and a second connecting piece 30532. One end of the first connecting piece 30531 is fastened on a top of the outer cover structure 302, and one end of the second connecting piece 30532 is fastened on a bottom of the outer cover structure 302. In addition, a pole connection assembly 3052 disposed on the pole also includes two pole connecting pieces: a first pole connecting piece 30521 and a second pole connecting piece 30522. The pole connection assembly 3052 is configured to connect the outer cover connection assembly 3053, to enable the outer cover structure 302 to be connected to the pole. Therefore, a disposing position of the pole connection assembly 3052 on the pole corresponds to a position of the outer cover connection assembly 3053. The first pole connecting piece 30521 includes a first tightening structure 30527 and a first connection base 30528. The tightening structure 30527 is a circular ring. The first connection base 30528 is fastened to the first tightening structure 30527. A quantity of connection bases connected to each tightening structure is not limited. The tightening structure 30528 is sleeved on the pole, and then the tightening structure is tightened by using a screw. The connection base is configured to connect the outer cover connection assembly 3053. If the base station antenna includes three outer cover structures 302, one tightening structure is connected to three connection bases, and the tightening structure and the connection base are in a "fan blade" shape. A structure of the second pole connecting piece 30522 is the same as that of the first pole connecting piece 30521. Details are not described herein.

Figure 14:
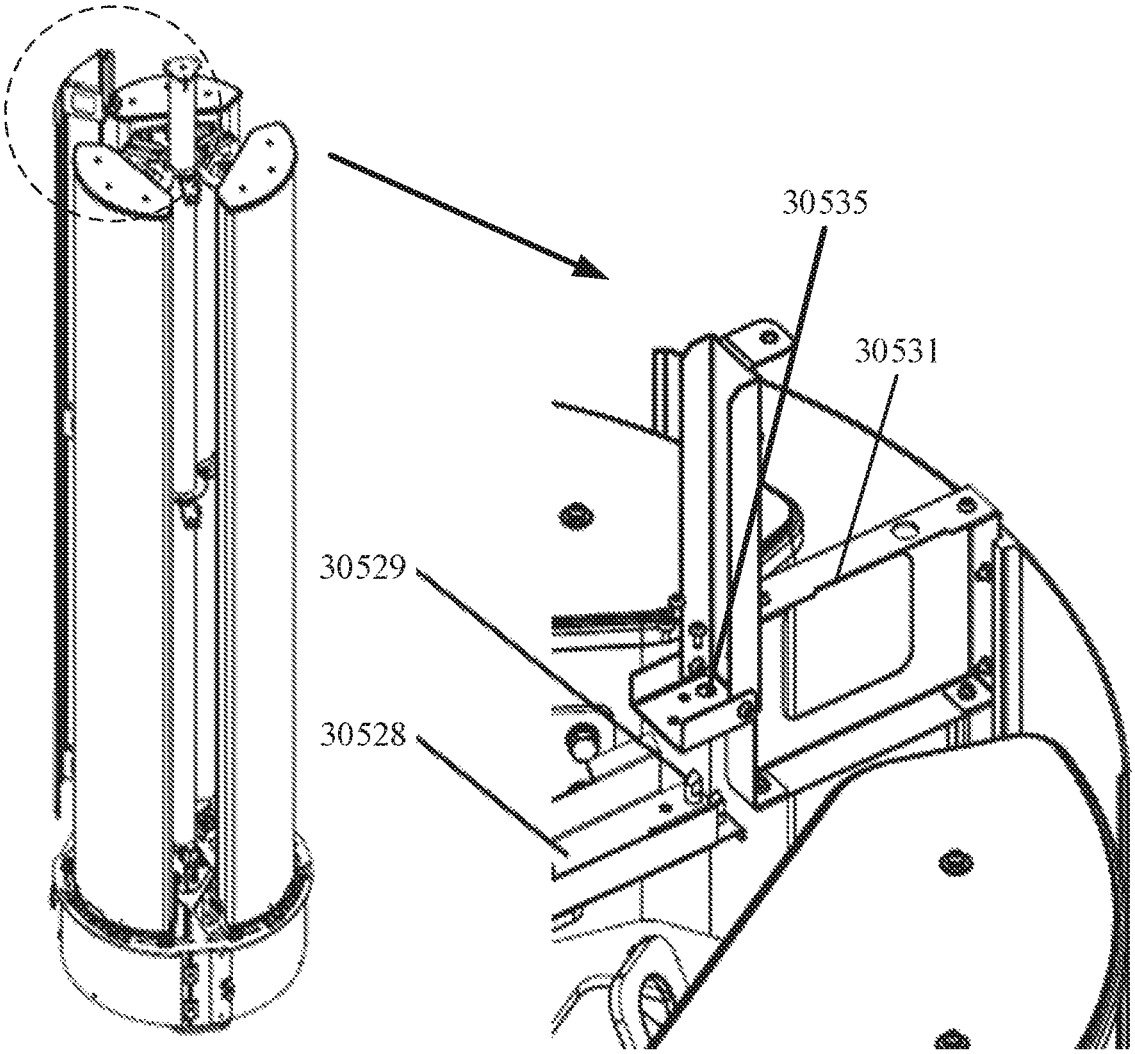
FIG. 14 is a schematic structural diagram in which an outer cover structure is mounted on a pole according to an embodiment of the present invention.

FIG. 14 is a schematic structural diagram in which the outer cover structure is mounted on the pole. One end of the first connecting piece 30531 is fastened on the top of the outer cover structure 302, the other end of the first connecting piece 30531 is connected to the first connection base 30528 of the first pole connecting piece 30521, and a reverse guide pin 30529 is disposed on the first connection base 30528. A guide pin hole 30535 is provided on the other end of the first connecting piece 30531, and the reverse guide pin 30529 passes through the guide pin hole 30535, so that the first connecting piece 30531 is fastened to the first connection base 30531.

One end of the second connecting piece 30532 is fastened on the bottom of the outer cover structure 302, the pole connection assembly 3052 includes a second connection base, a position of the second connection base corresponds to a position of the second connecting piece 30532, and the other end of the second connecting piece 30532 is connected to the second connection base. A reverse guide pin is disposed on the second connection base, and a guide pin hole is provided on the other end of the second connecting piece 30532. The reverse guide pin passes through the guide pin hole, so that the second connecting piece 30532 is fastened to the second connection base.

In this embodiment, the outer cover structure is connected to the pole by using the outer cover connection assembly and the pole connection assembly. Optionally, to enable the outer cover structure to connect to the pole more stably, the outer cover connection assembly may further include a third connecting piece 30533. One end of the third connecting piece 30533 is fastened at a middle part of the outer cover structure. Similarly, the pole connection assembly may further include a third pole connecting piece 30523, where the third pole connecting piece 30523 is disposed at a middle part of the pole. In addition, a position of the third pole connecting piece 30523 corresponds to a position of the third connecting piece 30533. One end of the third connecting piece 30533 is fastened at the middle part of the outer cover structure, the pole connection assembly includes a third connection base, and the other end of the third connecting piece 30533 is connected to the third connection base of the third pole connecting piece 30523. A reverse guide pin is disposed on the third connection base, a guide pin hole is provided on the other end of the third connecting piece 30533, and the reverse guide pin passes through the guide pin hole, so that the second connecting piece is fastened to the third connection base.

In this embodiment, even if in a process of adjusting an azimuth of a single antenna, the outer cover structure is always attached to an outer side wall of the antenna. That is, in this embodiment, a maximum angle at which the first bolt slides in the arc groove is less than the central angle of the attachment portion (a in Formula 1). In this way, it is ensured that in the process of adjusting the azimuth of the single antenna, the outer cover structure is always attached to the outer side wall of the antenna. In other words, even if the azimuth of the single antenna is adjusted, the outer cover structure is always attached to the outer side wall of the antenna. In this way, the radome and the outer cover structure jointly form the outer cover of the base station antenna. In this embodiment, the following problem in a conventional manner is resolved: The entire outer cover needs to be removed before an azimuth of a single antenna can be adjusted. In this embodiment, when the azimuth of the antenna needs to be adjusted, only the first bolt needs to be loosened, then the antenna is rotated, and the first bolt slides in the arc groove on the flange of the base, so that the azimuth of the single antenna is adjusted.

Figure 15:
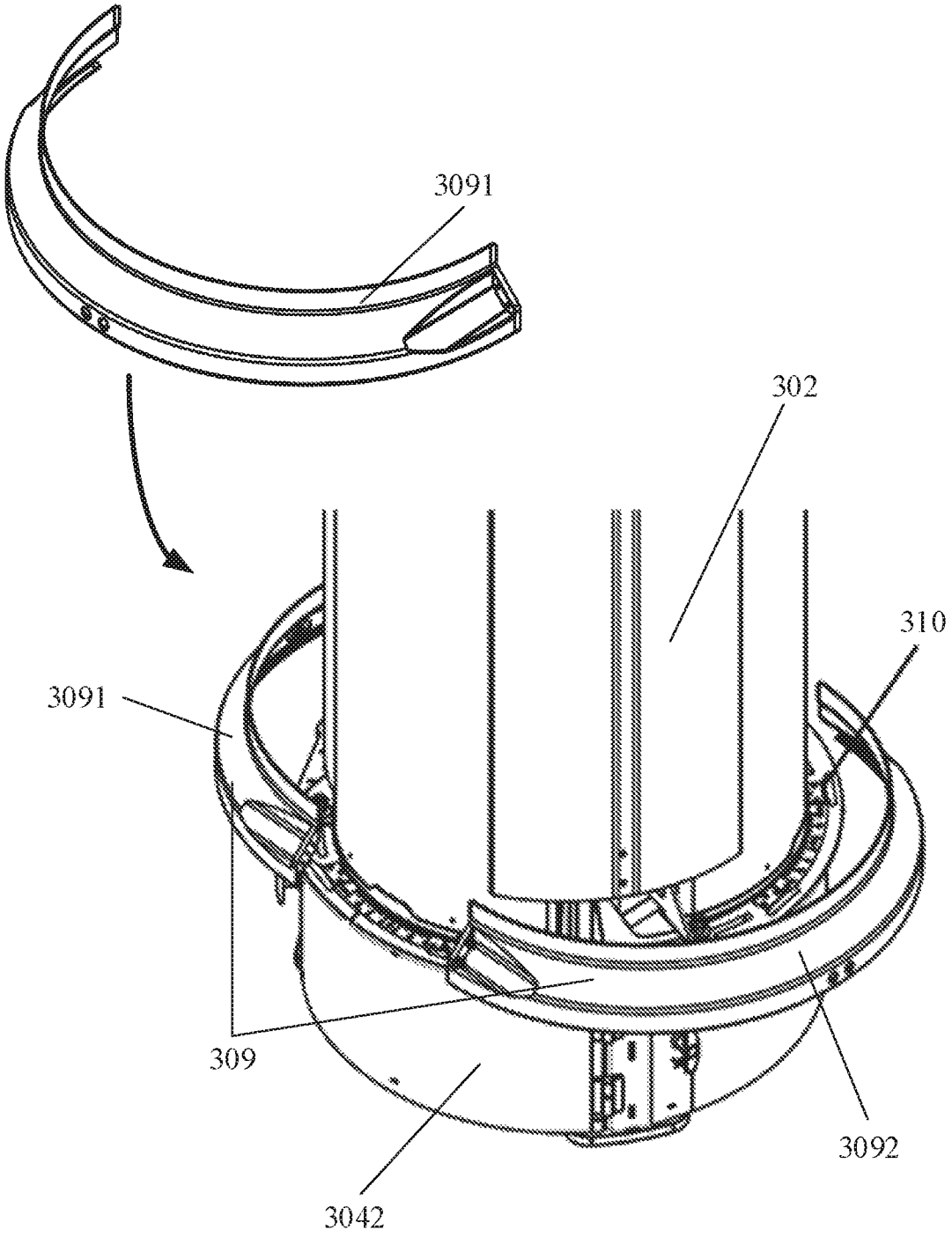
FIG. 15 is a schematic structural diagram of a shielding ring in a base station antenna according to an embodiment of the present invention.

Optionally, FIG. 15 is a schematic structural diagram of a shielding ring in a base station antenna. A shielding ring 309 is disposed at a part connecting a radome and a base. The shielding ring 309 is disposed on a bottom of the antenna, and is configured to seal a gap between an outer cover structure and the base.

The shielding ring 309 includes two parts, and each part is a semi-circular structure. The two parts are a first shielding ring 3091 and a second shielding ring 3092. In other words, the first shielding ring 3091 is of a semi-circular structure, and the second shielding ring 3092 is of a semi-circular structure. Screws are pre-installed on two ends of the first shielding ring 3091, and fastening nuts are disposed on two ends of the second shielding ring 3092. The first shielding ring 3091 and the second shielding ring 3092 are fastened on the bottom of the antenna through locking by using the screws and the nuts.

Optionally, a limiting structure 310 is disposed on a flange of the base, and the limiting structure is a buckle structure. A slot structure is disposed inside the shielding ring, and the shielding ring is fastened on the bottom of the antenna through fitting between the buckle structure and the slot structure, so that the shielding ring is prevented from moving upward and downward.

Figure 16:
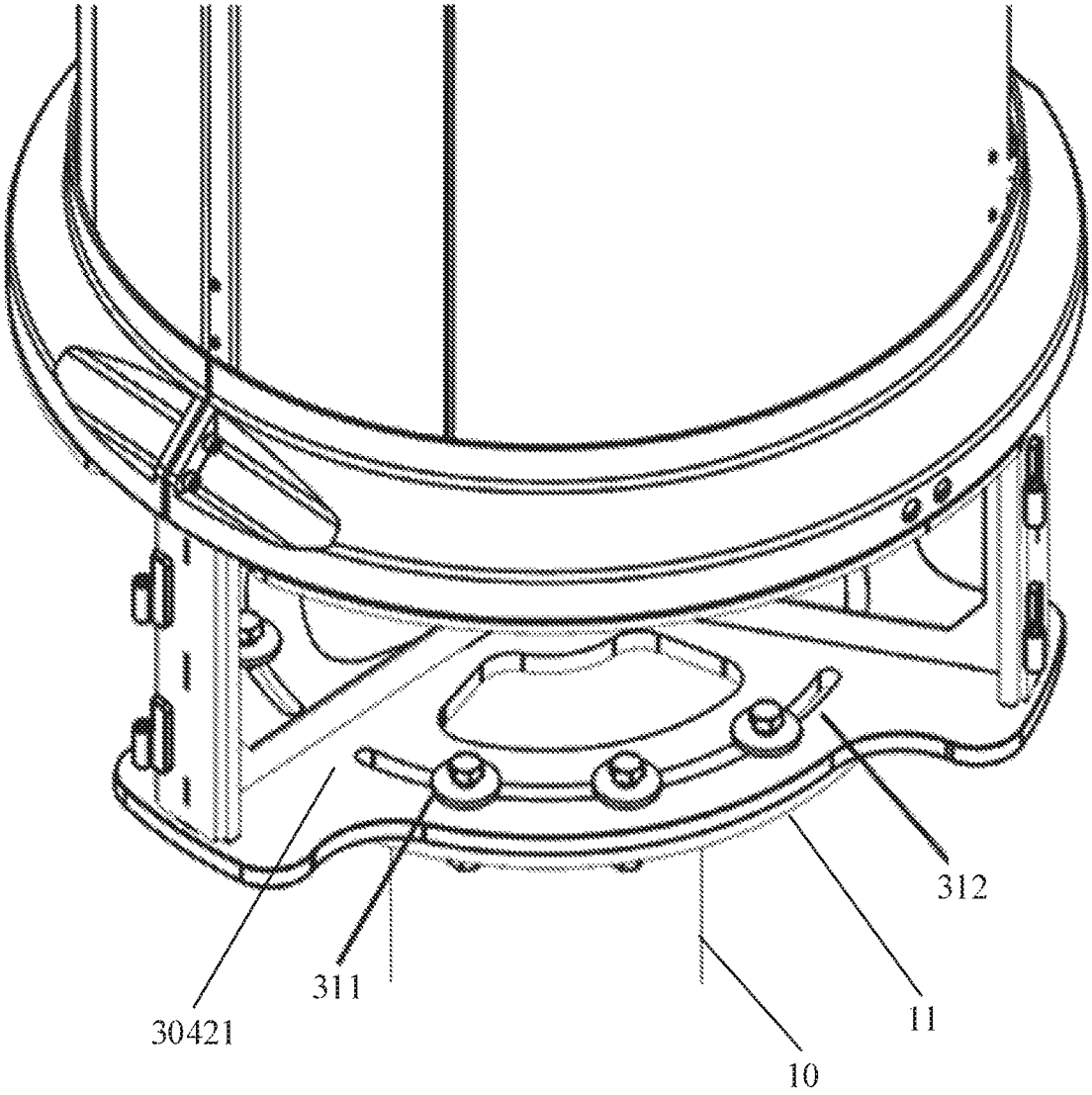
FIG. 16 is a schematic structural diagram in which a base is fastened on a monopole tower top according to an embodiment of the present invention.

Optionally, FIG. 16 is a schematic structural diagram in which a base is fastened on a monopole tower top. A bottom of the base 3042 is fastened to a bottom flange 30421, and a sliding groove 312 is provided on the bottom flange 30421. A base station antenna fastens the bottom flange 30421 to a flange 11 of the monopole tower top 10 by using a third bolt 311. The third bolt 311 passes through the sliding groove 312 to fasten the bottom flange 30421 to the flange of the monopole tower top 10. A relative position of the base 3042 to the flange 11 of the monopole tower top is changed by changing a position of the third bolt 311 in the sliding groove 312. When an azimuth of the base station antenna is adjusted, the third bolt 311 fastened to the flange 11 of the tower top is loosened, and the base station antenna is rotated leftward or rightward, so that the third bolt 311 rotates in the sliding groove 312, and the azimuth of the entire base station antenna is adjusted.

Figure 17:
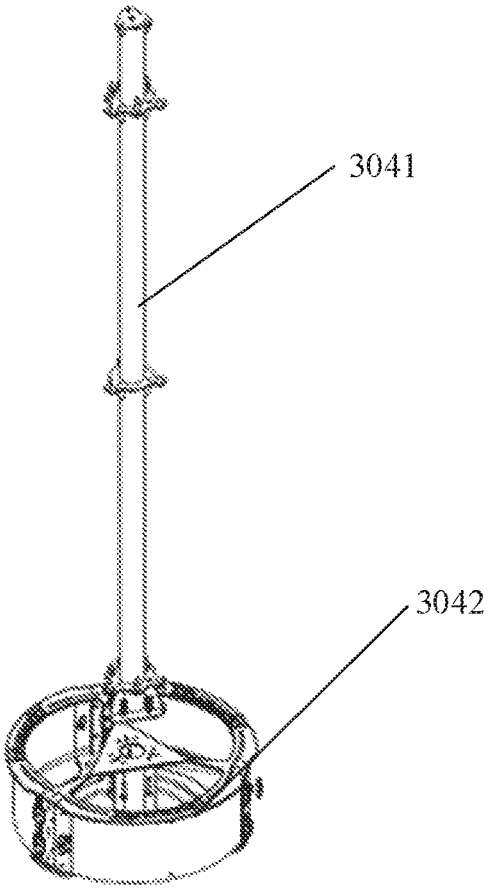
FIG. 17 is a schematic structural diagram of an integrated pole according to an embodiment of the present invention.
Figure 18:
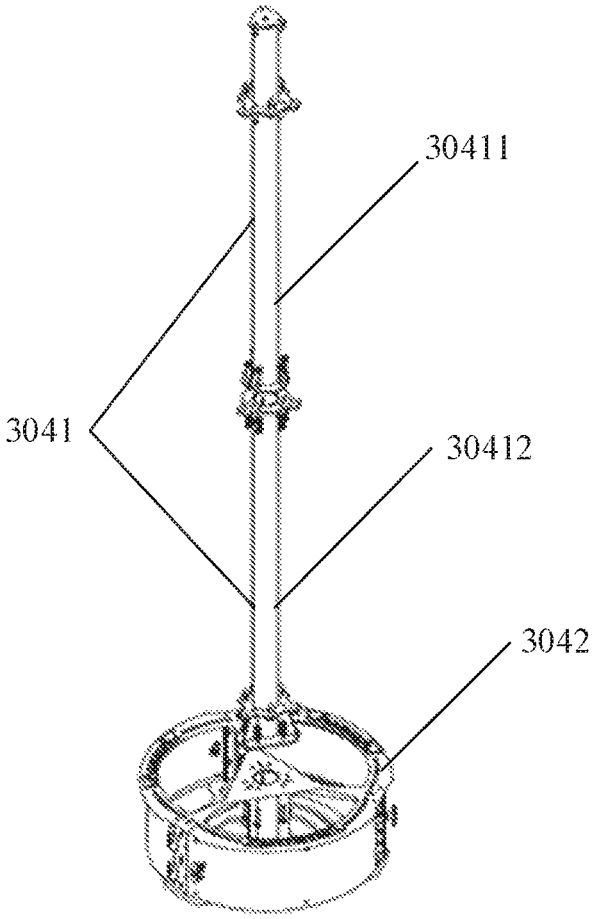
FIG. 18 is a schematic structural diagram of a separated pole according to an embodiment of the present invention.

Optionally, FIG. 17 is a schematic structural diagram of an integrated pole, and FIG. 18 is a schematic structural diagram of a separated pole. To facilitate installation and transportation in engineering, the pole may alternatively be of a separated structure. In a separated structure, the pole 3041 includes an upper pole 30411 and a lower pole 30412, and the upper pole 30411 is flexibly connected to the lower pole 30412.

The foregoing embodiments are merely intended for describing the technical solutions of the present invention, but not for limiting the present invention. Although the present invention is described in detail with reference to the foregoing embodiments, persons of ordinary skill in the art should understand that they may still make modifications to the technical solutions described in the foregoing embodiments or make equivalent replacements to some technical features thereof, without departing from the spirit and scope of the technical solutions of the embodiments of the present invention.

What is claimed is:

1. A base station antenna, comprising: at least two antennas, at least two outer cover structures, a fastening assembly, a connection assembly, and an upper cover, wherein each antenna is independently packaged in a radome;

wherein the fastening assembly comprises a pole and a base, and wherein a bottom of the pole is mounted on the base;

wherein the connection assembly comprises an antenna connection assembly, an outer cover connection assembly, and a pole connection assembly, wherein the pole connection assembly is disposed on the pole, wherein a top of the antenna is connected to the pole by using the antenna connection assembly and the pole connection assembly, and wherein a bottom of the antenna is fastened on the bottom of the pole;

wherein each of the outer cover structures is connected to the pole by using the outer cover connection assembly and the pole connection assembly, and wherein the upper cover is disposed on the top of the antenna;

wherein each of the outer cover structures and the antenna are disposed alternately, wherein an attachment portion on a side edge of the outer cover structure is attached to an outer side wall of the radome, and wherein an outer cover of the antenna comprises the outer side wall of the radome, the outer cover structure, and the upper cover;

wherein the antenna connection assembly comprises a bottom connecting piece, wherein the bottom connecting piece is fastened on the bottom of the antenna, and wherein a first fastening hole is provided on the bottom connecting piece;

wherein the base comprises an arc groove, wherein a first bolt passes through the first fastening hole to fasten the bottom connecting piece to the arc groove, wherein the first bolt moves in the arc groove, and wherein for each antenna, an azimuth of a single antenna is adjusted by centering on the pole; and wherein the pole comprises an upper pole and a lower pole, and wherein the upper pole and the lower pole are flexibly connected to each other.

2. The base station antenna according to claim 1, wherein the antenna connection assembly comprises a top connecting piece, wherein one end of the top connecting piece is fastened to the antenna, and wherein the other end of the top connecting piece is connected to the pole connection assembly.

3. The base station antenna according to claim 2, wherein a guide pin is disposed on the pole connection assembly, wherein a second fastening hole is provided on the other end of the top connecting piece, wherein the guide pin passes through the second fastening hole to fasten the other end of the top connecting piece to the pole connection assembly, and wherein the antenna rotates around the guide pin.

4. The base station antenna according to claim 1, wherein the upper cover is of a conical structure.

5. The base station antenna according to claim 1, wherein each outer cover connection assembly comprises a first connecting piece, wherein one end of the first connecting piece is fastened on a top of the outer cover structure, wherein the pole connection assembly comprises a first pole connecting piece, wherein the first pole connecting piece is disposed on a top of the pole, wherein a position of the first pole connecting piece corresponds to a position of the first connecting piece, wherein a reverse guide pin is disposed on the first pole connecting piece, wherein a guide pin hole is provided on the other end of the first connecting piece, wherein the reverse guide pin passes through the guide pin hole, and wherein the first connecting piece is fastened to a first connection base.

6. The base station antenna according to claim 5, wherein each outer cover connection assembly further comprises a second connecting piece, wherein one end of the second connecting piece is fastened on a bottom of the outer cover structure, wherein the pole connection assembly comprises a second pole connecting piece, wherein a position of the second pole connecting piece corresponds to a position of the second connecting piece, and wherein the other end of the second connecting piece is connected to the second pole connecting piece.

7. The base station antenna according to claim 1, wherein a shielding ring is disposed at a part connecting the radome and the base.

8. The base station antenna according to claim 1, wherein a bottom flange is fastened on a bottom of the base, wherein a sliding groove is provided on the bottom flange, wherein a third bolt passes through the sliding groove and fastens the bottom flange to a flange of a monopole tower top, and wherein an azimuth of the base station antenna is adjusted by changing a position of the third bolt in the sliding groove.

9. The base station antenna according to claim 1, wherein the radome is cylindrical, wherein a cross section of the radome is a sector, wherein the outer cover structure is a curved monolithic structure, and wherein a degree of a central angle of the outer cover structure is:

$$y = \frac{360^\circ - nx}{n} + a,$$

wherein x is a degree of a sector central angle of the antenna, n is a quantity of antennas, a is a degree of a central angle of the attachment portion, and 2a is less than x.

10. A base station, comprising a base station antenna, wherein the base station antenna comprises at least two antennas, at least two outer cover structures, a fastening assembly, a connection assembly, and an upper cover, wherein each antenna is independently packaged in a radome;

wherein the fastening assembly comprises a pole and a base, and wherein a bottom of the pole is mounted on the base;

wherein the connection assembly comprises an antenna connection assembly, an outer cover connection assembly, and a pole connection assembly, wherein the pole connection assembly is disposed on the pole, wherein a top of the antenna is connected to the pole by using the antenna connection assembly and the pole connection assembly, and wherein a bottom of the antenna is fastened on the bottom of the pole;

wherein each of the outer cover structures is connected to the pole by using the outer cover connection assembly and the pole connection assembly, and wherein the upper cover is disposed on the top of the antenna;

wherein each of the outer cover structures and the antenna are disposed alternately, wherein an attachment portion on a side edge of the outer cover structure is attached to an outer side wall of the radome, and wherein an outer cover of the antenna comprises the outer side wall of the radome, the outer cover structure, and the upper cover;

wherein the antenna connection assembly comprises a bottom connecting piece, wherein the bottom connecting piece is fastened on the bottom of the antenna, and wherein a first fastening hole is provided on the bottom connecting piece;

wherein the base comprises an arc groove, wherein a first bolt passes through the first fastening hole to fasten the bottom connecting piece to the arc groove, wherein the first bolt moves in the arc groove, and wherein for each antenna, an azimuth of a single antenna is adjusted by centering on the pole; and wherein the pole comprises an upper pole and a lower pole, and wherein the upper pole and the lower pole are flexibly connected to each other.

11. The base station according to claim 10, wherein the antenna connection assembly comprises a top connecting piece, wherein one end of the top connecting piece is fastened to the antenna, and wherein the other end of the top connecting piece is connected to the pole connection assembly.

12. The base station according to claim 11, wherein a guide pin is disposed on the pole connection assembly, wherein a second fastening hole is provided on the other end of the top connecting piece, wherein the guide pin passes through the second fastening hole to fasten the other end of the top connecting piece to the pole connection assembly, and wherein the antenna rotates around the guide pin.

13. The base station according to claim 10, wherein the upper cover is of a conical structure.

14. The base station according to claim 10, wherein each outer cover connection assembly comprises a first connecting piece, wherein one end of the first connecting piece is fastened on a top of the outer cover structure, wherein the pole connection assembly comprises a first pole connecting piece, wherein the first pole connecting piece is disposed on a top of the pole, wherein a position of the first pole connecting piece corresponds to a position of the first connecting piece, wherein a reverse guide pin is disposed on the first pole connecting piece, wherein a guide pin hole is provided on the other end of the first connecting piece, wherein the reverse guide pin passes through the guide pin hole, and wherein the first connecting piece is fastened to a first connection base.

15. The base station according to claim 14, wherein each outer cover connection assembly further comprises a second connecting piece, wherein one end of the second connecting piece is fastened on a bottom of the outer cover structure, wherein the pole connection assembly comprises a second pole connecting piece, wherein a position of the second pole connecting piece corresponds to a position of the second connecting piece, and wherein the other end of the second connecting piece is connected to the second pole connecting piece.

16. The base station according to claim 10, wherein a shielding ring is disposed at a part connecting the radome and the base.

17. The base station according to claim 10, wherein a bottom flange is fastened on a bottom of the base, wherein a sliding groove is provided on the bottom flange, wherein a third bolt passes through the sliding groove and fastens the bottom flange to a flange of a monopole tower top, and wherein an azimuth of the base station antenna is adjusted by changing a position of the third bolt in the sliding groove.

18. The base station according to claim 10, wherein the radome is cylindrical, wherein a cross section of the radome is a sector, wherein the outer cover structure is a curved monolithic structure, and wherein a degree of a central angle of the outer cover structure is:

$$y = \frac{360^\circ - nx}{n} + a,$$

wherein x is a degree of a sector central angle of the antenna, n is a quantity of antennas, a is a degree of a central angle of the attachment portion, and 2a is less than x.

* * * * *